United States Patent [19]

Henryson

[11] 4,280,787

[45] Jul. 28, 1981

[54] METHOD FOR HANDLING PALLETED LOADS COMPRISING BULK MATERIAL CONTAINED IN BAGS

[75] Inventor: Leif A. S. Henryson, Mörarp, Sweden

[73] Assignee: AB Bergu Jarn- & Rorkonstruktioner, Helsingborg, Sweden

[21] Appl. No.: 50,936

[22] Filed: Jun. 21, 1979

Related U.S. Application Data

[62] Division of Ser. No. 808,756, Jun. 22, 1977, Pat. No. 4,182,592.

[30] Foreign Application Priority Data

Jun. 28, 1976 [SE] Sweden ..... 7607344

[51] Int. Cl.[3] ..... B65G 65/04

[52] U.S. Cl. ..... 414/786

[58] Field of Search ..... 414/411, 412, 786; 241/260.1, 277

[56] References Cited

U.S. PATENT DOCUMENTS

| | | | |
|---|---|---|---|
| 152,609 | 6/1874 | Craig | 241/260.1 |
| 2,818,985 | 1/1958 | Irmscher | 414/412 |
| 3,224,609 | 12/1965 | Dietert | 414/412 |
| 3,386,602 | 6/1968 | Kanorep | 414/412 |
| 3,596,842 | 8/1971 | Barber | 414/412 |
| 3,968,998 | 7/1976 | Wolf | 241/260.1 |

FOREIGN PATENT DOCUMENTS

| | | | |
|---|---|---|---|
| 1145547 | 1/1961 | Fed. Rep. of Germany | 414/412 |
| 453367 | 1/1975 | U.S.S.R. | 241/260.1 |
| 477062 | 7/1975 | U.S.S.R. | 414/412 |

*Primary Examiner*—Lawrence J. Oresky

[57] ABSTRACT

To a device for handling cut-open bags containing bulk material, by separating the bag material from the bulk material there is connected a screw conveyor having a hopper for receiving several bags of a pallet load and being arranged to supply the bags to the separating device at the same time tearing open the bags.

3 Claims, 6 Drawing Figures

FIG. 3
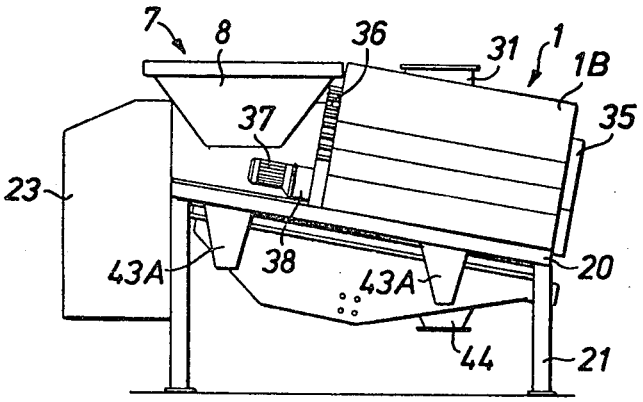
FIG. 5
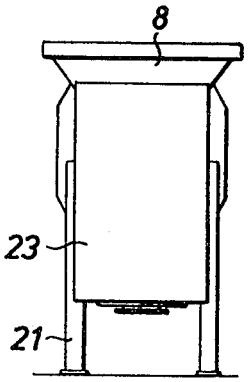
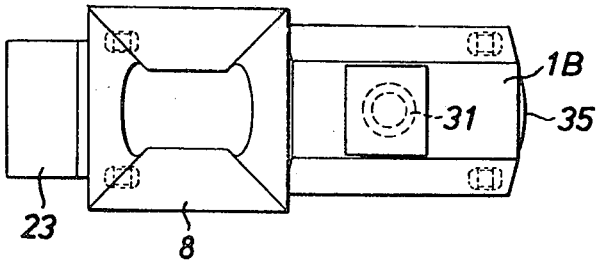
FIG. 4

METHOD FOR HANDLING PALLETED LOADS COMPRISING BULK MATERIAL CONTAINED IN BAGS

This is a division of application Ser. No. 808,756 filed June 22, 1977, now U.S. Pat. No. 4,182,592 issued Jan. 8, 1980.

This invention relates to a method and an apparatus for handling palleted loads of bulk material contained in bags.

In the industry, agriculture and forestry there are used to a great extent pulverulent, granulated, grainy or other bulk materials for various completely different purposes.

Some of these materials are transported in bulk from the manufacturer to the place of use and are stored there in silos from which the material is supplied as bulk material for the intended purpose, but to a very great extent materials of the kind referred to are also filled into bags of different sizes, usually paper, plastic, reinforced plastic or jute bags, at the place of production and the bags are stowed on pallets (palleted), the pallets with the bags thereon then being loaded on trucks and other vehicles as unitary loads and being transported to the place of use where the pallets with their load are stored waiting for the intended use.

However, the bags the only purpose of which is to form an enclosing wrapper during transport and storage of the bulk material provide an inconvenient complication when the bulk material is to be used for its purpose due to the fact that the bags must be emptied and the contents thereof must be separated from the bag material.

In order to facilitate this operation there have been developed specific bag tearing and separating machines wherein the bags are cut open or divided into pieces and the residues of the bags are removed from the bulk material.

A drawback of these prior art bag tearing and separating machines is that they must be charged with one bag at a time. In order to transfer a pallet load of bags to the machine one must accordingly see to it that the bags, one at a time, are supplied to the machine. For this operation there are no reliable mechanical facilities available and, therefore, the operation is performed manually. The work is heavy and tiring and limits the capacity of the machine. Thus, the possibility to utilize to a full extent the advantages obtained by the pallet distribution of bags is substantially decreased.

When pallet loads of bags are transported and handled it cannot be avoided that occasional bags are damaged so that part of the contents thereof will run out. It is estimated that a normal damage percentage for pallet loads of bags ranges from 2 to 5%. This has turned out to provide an embarrassing inconvenience in the working environment at the manual handling of the bags when they are being fed manually one at a time into the bag tearing and separating machine. Considering the fact that the materials transported in bags rather often can be injurous to health it is realized that the handling technique lined out above not only is cumbersome but also provides great environment problems.

It is a primary object of this invention to provide new and improved method and apparatus for handling palleted loads of bulk material contained in bags, which avoid the drawbacks discussed above.

It is a further object of this invention to provide new and improved method and apparatus of the kind referred to which provide a rational utilization of the advantages of the bag palleting by automation of the bag handling when palleted loads are supplied to a bag separating apparatus.

A still further object of this invention is to provide new method and apparatus of the kind referred to which provide an improvement of the working environment.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the method of this invention for handling palleted loads of bulk material contained in bags, comprises the steps that several bags of the pallet load are dumped collectively from the pallet, that the dumped load is allowed to fall by gravity and is guided to be brought into contact with the screw of a screw conveyor, that the screw of the screw conveyor is rotated for tearing open the bags and at the same time conveying bag material together with bulk material to the outlet of the screw conveyor, and that the materials are supplied to a device for separating the bag material and the bulk material from each other.

The apparatus for handling palleted loads of bulk material contained in bags by working said method comprises a device for separating bag material from bulk material, a bag feeder for charging the separating device, including a downwardly tapering receiving hopper, the lower end of which is connected to and opens into a housing of a screw conveyor, said hopper forming an inlet opening at the top thereof to allow several bags of the pallet load to be dumped collectively into the hopper, and tearing means on the screw of the screw conveyor to cut through, at the rotation of the screw, bags received from the hopper, the outlet end of the screw conveyor being operatively connected to the separating device for feeding bag material and bulk material axially to the separating device.

Preferably the thread of the conveyor screw of the bag feeder screw conveyor forms a sharp edge at least in the area of the lower opening of the hopper or the conveyor screw is provided with knives, cut-outs or spikes.

It is also preferred that the screw conveyor has the outlet end thereof opening directly into the inlet opening of the separating device.

The accompanying drawings, which are incorporated in and constitute a part of this specification, illustrate embodiments of the invention and, together with the description, serve to explain the principles of the invention.

Of the drawings:

FIG. 1 illustrates a plant according to the invention;

FIG. 2 discloses an alternative embodiment according to the invention;

FIG. 3 is a side view of a constructive embodiment of the apparatus according to the invention;

FIG. 4 is a plan view of the apparatus disclosed in FIG. 3;

FIG. 5 is an end view of the apparatus disclosed in FIGS. 3 and 4; and

Reference will now be made in detail to the present preferred embodiments of the invention, examples of which are illustrated in the accompanying drawings.

Figure 1:
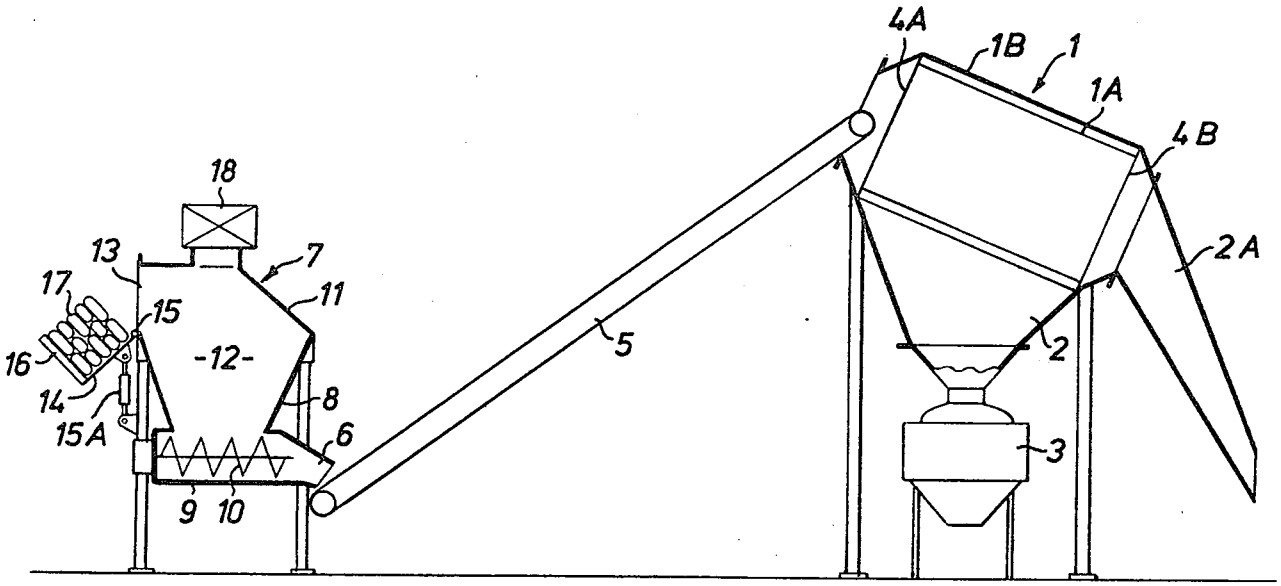

Referring now to FIG. 1, the plant illustrated therein comprises a separating device 1 of a type known in the art. This separating device comprises an inclined cylindrical screen drum 1A having an inlet end 4A and an outlet end 4B, which is rotatably mounted in a housing 1B and is rotated by suitable drive means. When the drum is rotated the contents of cut-open bags supplied to the drum 1A at the inlet end 4A will be discharged through the screen drum into an outlet hopper 2 arranged below the drum, the residues of the bag being fed axially and discharged from the outlet end 4B of the drum through an outlet passage 2A for further handling. Below the outlet hopper 2 there is shown a container 3 for receiving the material discharged from the bags. Such container forms no part of the invention and can be replaced by other suitable means for receiving the material.

The bag separating device can be of the type described in the published Norwegian patent application No. 2787/71 filed July 28, 1971.

An inclined belt conveyor 5 runs to the inlet end 4A of the bag separating device 1 at the upper end of the conveyor. The belt conveyor can be provided with carriers. Any other type of conveyor such as a screw conveyor can be provided. The conveyor 5 preferably is enclosed in a housing, not shown, surrounding the conveyor. The other, lower end of the conveyor 5 runs under the outlet opening 6 of a bag feeder 7. Said bag feeder comprises an inverted pyramidical hopper 8, which is connected at the lower end thereof to the circular cylindrical housing 9 of a screw conveyor and communicates therewith through an opening in said housing. In the housing 9 there is rotatably mounted a conveyor screw 10 which is driven by drive means, not shown, for feeding material received by the screw conveyor towards the lower end of the conveyor 5. The inlet hopper 8 of the bag feeder 7 is provided at the top thereof with a cover 11 which defines together with the inlet hopper 8 a closed space 12 which can be charged through an inlet opening 13 with a pallet load of bags containing bulk material. Preferably, the inlet opening 13 is closed by means of a closure, not shown, preferably comprising yieldable and displaceable rubber doors. At the lower edge of the inlet opening 13 there is mounted a charging device 14 for pivotal movement about a horizontal axis 15 by power means, such as hydraulic cylinders 15A. The charging device 14 is provided with suitable means for securing a pallet 16 of standard size to said device perpendicularly thereto.

The pallet 16 carries a pallet load of bags 17 to be supplied to bag feeder 7 through the opening 13 into the inlet hopper 8 by swinging the charging device 14 about the axis 15. The inlet opening 13 is dimensioned with due consideration of the dimensions of the pallet load 17 so that dumping of the entire pallet load through said inlet opening is possible. In the upper part of the cover 11 there is arranged an exhausting device 18 having filtering means for exhausting air having particles entrained therein and simultaneously separating such particles from the air.

The dimensions of the inlet hopper 8 which has smooth inside surfaces are chosen in relation to the size of the pallet and the bags, respectively, in such a way that packing and "arching" of the bags are prevented. Tests have shown that the pitch of the conveyor screw 10 should be adapted to the size of the bags to be handled in the apparatus, a greater size corresponding to a greater pitch and a smaller size corresponding to a smaller pitch. A pitch of the order of 400 mm has been found to be suitable for bags having a length ranging substantially from about 1,000 mm to about 450 mm.

The apparatus described operates in the following manner:

By means of a fork truck a pallet with bags 17 is placed on the charging device 14 and attached thereto. Then the operating means 15A of the charging device are activated, said means forcing the charging device and the pallet load 17 carried thereby to swing clockwise about the axis 15 to such a position that the bags loaded on the pallet 16 will be dumped collectively from the pallet into the inlet hopper 8. At this operation it is not necessary that the operator is in the immediate vicinity of the bag feeder; preferably he is stationed in an operator's cabin which is well protected against dust and from which the apparatus can be remotely controlled. When the bags are dumped into the inlet hopper 8, the bags slide downwards, come into contact with the rotating feed screw 10 and will be cut open by the periphery of the screw. The bag material and the bulk material will be fed axially by the screw conveyor 9, 10 towards the belt conveyor 5 which carries the material into the inlet end 4A of the separating device 1, where the bag material is separated from the bulk material in a known manner.

In some cases occasional bags could pass through the conveyor 10 in an intact condition. If this can be expected there may be arranged in the screen drum 1A means such as knives or other sharp-edged projections for cutting open such intact bags, if any, arriving at the bag separating device.

Figure 2:
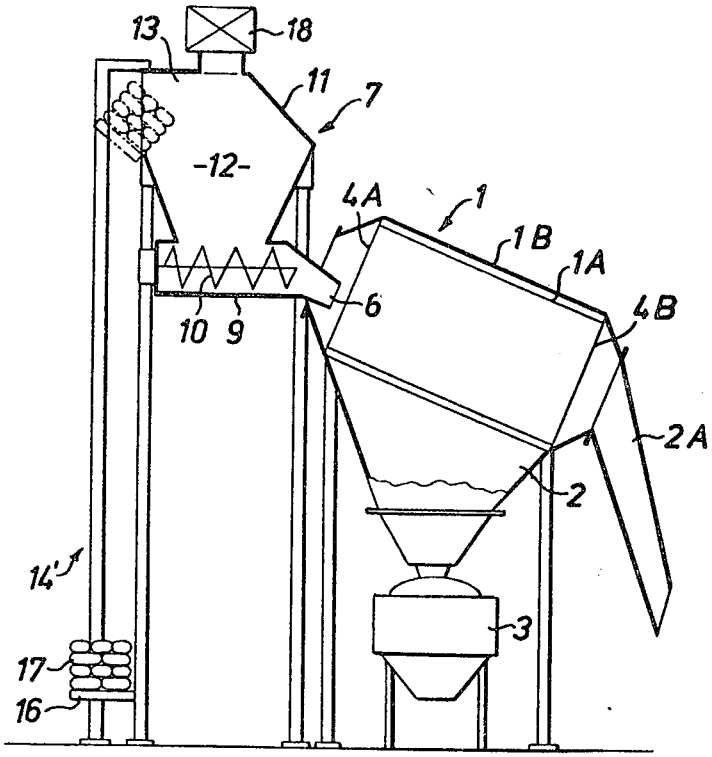
Figure 6:
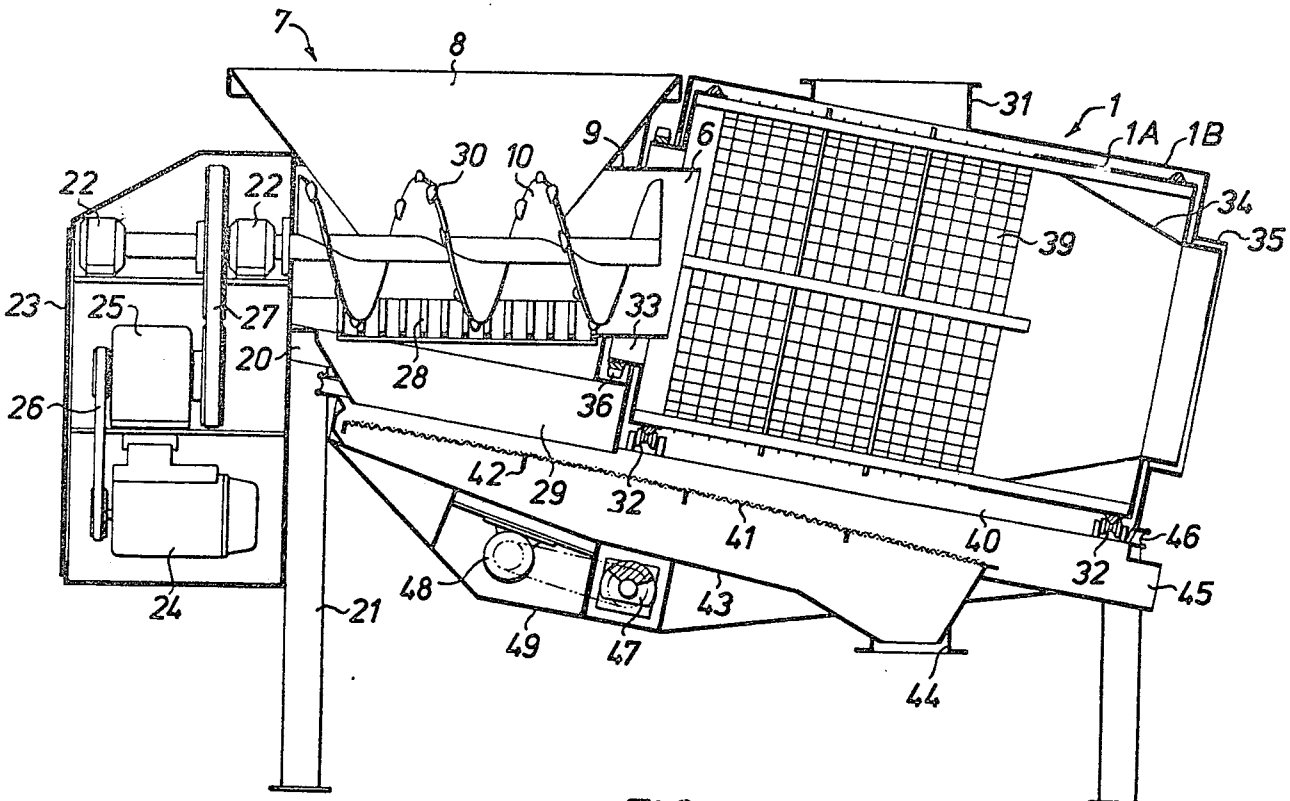
FIG. 6 is an enlarged vertical sectional view of the apparatus disclosed in FIGS. 3 to 5.

In the embodiment disclosed in FIG. 2 the conveyor 5 has been dispensed with the bag feeder 7 being located with the outlet opening 6 thereof discharging into the inlet end 4A of the separating device 1. The bag feeder 7 is located at an elevated level above the floor and therefore the charging device is constructed as a pallet elevator 14' arranged to dump the pallet load 17 resting on the pallet 16 into the inlet opening 13 of the bag feeder 7 in the upper position of the pallet elevator. The plant operates in the same manner as described with reference to FIG. 1.

In order to secure tearing of all bags supplied to the bag feeder 7 the screw 10 preferably should be formed with sharp edges along the periphery of the thread thereof. According to another preferred embodiment the screw is provided with spikes, cut-outs or other tearing members such as knives in order to increase thereby the capacity and the tearing effect. The screw 10 can, of course, also be provided with tearing means on the shaft of the screw.

The apparatus disclosed in FIGS. 3 to 6 comprises a frame 20 with vertical supporting legs 21, on which there is mounted a screw conveyor comprising a cylindrical housing 9 and a conveyor screw 10 which is rotatably mounted at one end in bearings 22 fixedly supported by a drive unit 23 which in turn is mounted to the frame 20 to be supported thereby. In the drive unit 23 there is mounted an electric motor 24 operatively connected to a gear box 25 over a belt transmission 26 and said gear box is operatively connected to the conveyor screw by means of a belt transmission 27. The bag feeder 7 comprises an inverted pyramidical hopper 8 the lower end of which connects to the housing 9 to communicate with the interior of the housing. The bottom of the housing 9 comprises a grid having circumferentially extending curved bars 28 and below the housing there is provided an outlet 29 which is connected to or forms part of the housing 9 for discharging material falling down through the grid 28. The screw 10 is provided with projecting knives 30 at the periphery of the screw thread. Other tearing means may be arranged on the screw such as a sharp edge on the screw thread, cut outs in the screw thread or knives projecting from the screw shaft.

The housing 9 forms an open end 6 which opens into a separating device 1. This device comprises a stationary housing 1B supported by the frame 20 and having a connection stud 31 at the top thereof, and a drum 1A which is rotatably mounted in the housing 1B by means of circumferential journal rollers 32. The drum has a cylindrical collar 33 at one end thereof which receives the end portion 6 of the conveyor housing 9. The drum is mounted in an inclined position sloping from the end thereof provided with the collar 33 to the other end thereof which has a conical outlet portion 34 which opens through a collar 35 formed by the stationary housing 1B. On the outside of the collar 33 there is provided a gear ring 36 over which the drum is rotated by an electric motor 37 operatively connected to the gear ring over a gear box 38.

The rotatable drum 1A comprises a grid portion 39 and the housing 1B is open at the lower side thereof to provide a discharge opening 40 for material passing through the grid portion from the interior of the drum.

Below the outlet 29 and the discharge opening 40 there is provided a sloping sieve 41 such as a metal wire netting supported by cross bars 42 in a sloping tray 43 which forms a bottom outlet 44 below the sieve and an end outlet 45 above the sieve at the lower end thereof. The tray 43 is mounted to the frame 20 by elastic mounting means 43A wherein the tray is supported by means of cushioning rubber elements. A flexible circumferential element 46 connects the tray to the outlet 29 and the housing 1B and forms a seal between the outlet and the housing at one hand and the tray at the other hand. On the lower side of the bottom of the tray there is mounted a vibrator 47 of the type having an unbalanced rotatable weight which is operatively connected to an electric motor 48 to be rotated thereby, said motor being mounted to the tray. The vibrator 47 and the associated drive motor 48 as well as the drive transmission therebetween are enclosed by means of a cover 49.

During operation of the apparatus described with reference to FIGS. 3 to 6 the screw 10 is rotated to feed from the left end thereof to the right end in order to forward material supplied through hopper 8 to the open end 6 of the housing 9. The inclined drum 1B is also rotated in optional direction and the tray 43 with the sieve 41 below the outlet 29 and the outlet opening 40 is held in vibrating or shaking motion by means of the vibrator 47. Several bags are supplied at a time from pallets to the hopper 8 in the manner previously described—they can be dumped directly from a fork truck into the hopper 8—and are cut open by means of the feed screw 10 and the knives 30 provided on the screw, the bags at the same time being fed to the open end 6 of the housing 9. Bulk material of the bags running out from the cut-open bags falls down through the grid 28 together with portions of the bag material and is received on the upper surface of the vibrating sieve 41. The rest of the material, the bulk material as well as the bag material is supplied to the drum 1A wherein remaining bulk material will be released from the bag material and will fall down onto the upper surface of the sieve 41 through the grid portion 39 possibly together with minor portions of the bag material. The bulk of the bag material will be discharged through outlet cone 34 at the lower end of the drum 1A and will be collected by suitable means outside the apparatus such as a belt conveyor or a container.

During vibration of the sieve 41 the bulk material will pass through the sieve and will be received on the bottom of the tray 43 below the sieve, pieces of the bag material entrained with the bulk material passing along the upper surface of the sieve to the lower end thereof in order to be discharged through the end outlet 45. Also this bag material will be received by the same means as that collecting the bag material from outlet cone 34. The bulk material collected on the bottom of the tray 43 is forwarded to the bottom outlet 44 by the vibrating motion of the tray and is collected for the intended purpose in a suitable container or on a conveyor To the stud 31 on top of the housing 1B there can be connected a suction conduit for drawing off dust developing in the interior of the apparatus when the bulk material is separated from the bag material.

As will be gathered from the above description of the illustrated embodiments, the invention eliminates the need of manual handling of the individual bags whereby it is possible to handle pallet loads of bags as unitary loads continuously to the final cutting-up of the bags. Moreover, the invention provides an extensive automation of the bag handling and thereby eliminates an environment problem which was earlier very inconvenient.

It will be apparent to those skilled in the art that various other modifications and variations in addition to those mentioned above could be made in the method and apparatus of the invention without departing from the scope and spirit of the invention.

What is claimed is:

1. A process for handling palleted loads of bulk material contained in bags, comprising the following steps, in combination and in sequence:

(1) dumping a plurality of bags of a pallet load together into a downwardly tapering receiving hopper having an inlet opening at the top thereof;

(2) guiding the bags while allowing the bags to fall downwardly by gravity into contact with the screw of a screw conveyor, the screw having a sharp edge at least in the area of the lower opening of the hopper, and having cutting and tearing means projecting outwardly;

(3) rotating the conveyor screw and thereby cutting through and opening the bags received from said hopper;

(4) allowing some of the cut bag material and some of the bulk material to fall through grid means at the bottom of the housing of the screw conveyor, the grid means having a smooth inside surface formed by the innermost curved surfaces of said grid means, with said innermost surfaces being slightly spaced from said conveyor screw;

(5) separating the said bag and bulk materials from each other by a first separating means and feeding the rest of the bag material and bulk material axially towards the outlet and of the screw conveyor, in which the outlet end of the screw conveyor opens directly into an inlet of a second separating device for separating bag and bulk material; and (6) separating the rest of the bag material.

2. A process according to claim 1, wherein the cutting and tearing means on the conveyor screw comprise projecting knife members.

3. A process according to claim 1 in which the first separating device comprises sieving means receiving bulk material discharged from the conveyor housing through the grid means and from the separating device.

* * * * *